US006209904B1

(12) United States Patent
Schnitzhofer

(10) Patent No.: US 6,209,904 B1
(45) Date of Patent: Apr. 3, 2001

(54) BINDING FOR SNOWBOARDS

(76) Inventor: Josef Peter Schnitzhofer, Sonnhalb 36, A-5511 Hüttau (AT)

( * ) Notice: Subject to any disclaimer, the term of this patent is extended or adjusted under 35 U.S.C. 154(b) by 0 days.

(21) Appl. No.: 09/142,586

(22) PCT Filed: Mar. 20, 1997

(86) PCT No.: PCT/AT97/00059

§ 371 Date: Sep. 11, 1998

§ 102(e) Date: Sep. 11, 1998

(87) PCT Pub. No.: WO97/34667

PCT Pub. Date: Sep. 25, 1997

(30) Foreign Application Priority Data

Mar. 20, 1996 (AT) ..... 513/96

(51) Int. Cl.[7] ..... A63C 9/08

(52) U.S. Cl. ..... 280/616; 280/618; 280/14.22

(58) Field of Search ..... 280/607, 613, 280/616, 617, 618, 14.2, 14.22, 14.21, 14.23

(56) References Cited

U.S. PATENT DOCUMENTS

| | | | | |
|---|---|---|---|---|
| 3,061,325 | * | 10/1962 | Glass | 280/613 |
| 3,583,719 | * | 6/1971 | Marker | 280/618 |
| 3,950,001 | * | 4/1976 | Weigl | 280/617 |
| 3,951,424 | * | 4/1976 | Napflin | 280/618 |
| 3,955,825 | * | 5/1976 | Kubelka et al. | 280/618 |
| 4,021,056 | * | 5/1977 | Oakes | 280/613 |
| 4,498,685 | * | 2/1985 | Zoor | 280/618 |
| 4,629,208 | * | 12/1986 | Gertsch et al. | 280/618 |
| 4,652,007 | | 3/1987 | Dennis . | |
| 4,971,351 | * | 11/1990 | Flick | 280/613 |
| 5,505,478 | | 4/1996 | Napoliello . | |
| 5,615,901 | * | 4/1997 | Protrowski | 280/618 |

FOREIGN PATENT DOCUMENTS

| | | |
|---|---|---|
| 681062 | 1/1993 | (CH) . |
| 682133 | 7/1993 | (CH) . |
| 4207143 | 9/1993 | (DE) . |
| 0373548 | 12/1989 | (EP) . |
| 2647355 | 11/1990 | (FR) . |
| 8800076 | 1/1988 | (WO) . |
| 8910167 | 11/1989 | (WO) . |

* cited by examiner

*Primary Examiner*—Michael Mar
(74) *Attorney, Agent, or Firm*—Dykema Gossett PLLC

(57) ABSTRACT

A binding for snowboards and the including binding base plates (1*a,* 1*b*) which are attached on the snowboard, two binding carrier plates (2*a,* 2*b*) which are provided with fastening apparatuses in order to be fastened to one shoe of the rider of the snowboard, with holding elements (3*a,* 3*b*) being provided on the binding base plates (1*a,* 1*b*) which are designed to hold the binding carrier plates (2*a,* 2*b*), but to release the same at a predetermined releasing force, and with a connecting element being provided in order to forcibly release the other binding carrier plate (2*a,* 2*b*) from the binding base plate (1*a,* 1*b*) during the release of one binding carrier plate (2*a,* 2*b*). A secure release is achieved in such a way that guide elements (8*a,* 8*b,* 13*a,* 13*b*) are provided on the binding base plates (1*a,* 1*b*) which allow the release of the binding carrier plate (2*a,* 2*b*) only in the longitudinal direction of the snowboard.

14 Claims, 6 Drawing Sheets

6
6b
5b
4
4
15b
3b
11b
13b
12
11

BINDING FOR SNOWBOARDS

BACKGROUND OF THE INVENTION

1. Field of the Invention

The present invention relates to a binding for snowboards and the which includes binding base plates that are attached on the snowboard, two binding carrier plates which are provided with fastening apparatuses in order to be fastened to one shoe of the rider of the snowboard, with holding elements being provided on the binding base plates which are designed to hold the binding carrier plates, but to release the same at a predetermined releasing force, and with a connecting element being provided in order to forcibly release the other binding carrier plate from the binding base plate during the release of a binding carrier plate.

2. The Prior Art

In the field of skis the safety bindings have generally been accepted for a long time in order to protect the skier from excessive forces in the event of falls or the like. Similarly, bindings were developed for snowboards for the same purpose. However, as the rider of a snowboard stands with both legs transversally to the longitudinal axis of the snowboard, or diagonally on the same, the requirements placed on such a safety binding differ from those in the case of skiers. It is a particularly important aspect that it is ensured in snowboards that, in the event of the opening of one binding, the other binding also opens simultaneously.

From CH-A 681 062 a safety binding for snowboards or the like is known in which the bindings are mutually connected by way of a connecting rod. As a result of this connecting rod, the opening of the one binding also leads to the opening of the other binding. The release of the binding occurs through a torsional moment about the normal axis, as is also known in ski bindings. The special properties of a snowboard in comparison with skis are not taken sufficiently into account in such a safety binding.

Moreover, from EP-A 0 352 662 a sport sliding board is known which comprises two bindings which are mutually coupled in order to release simultaneously. In this case the release also occurs by the torsional moments about the normal axis or by tilting moments about the longitudinal axis.

Further apparatuses for coupling the release of bindings are known from FR-A 2 651 143 and from WO 93/16768.

The common feature in all such apparatuses is that, although the joint release of two bindings is ensured more or less properly, the conventional approach is used for the release per se.

It is the object of the present invention to avoid these disadvantages and to provide a binding for snowboards which is optimally adjusted to the special kinematic properties and those of the dynamics of movement of such a sports device.

SUMMARY OF THE INVENTION

This object is achieved in accordance with the invention in such a way that guide elements are provided on the binding base plates which allow the release of the binding carrier plate only in the longitudinal direction of the snowboard.

The invention is based on the finding that the torsional strain of the legs of a snowboard rider does not represent an actual value. Riding or falling scenarios which exclusively entail an excessively large torsional strain of the rider's legs do not occur in practice or only to a negligible extent.

Situations are more critical in which intolerable forces are exerted in the longitudinal direction of the snowboard. This is the case, for example, when the snowboard is abruptly stopped at high speeds by an obstruction or lands on a hard spot after a jump with the forward or rearward end. Excessive torsional trains occur as an accompanying phenomenon in such situations, if at all, so that a binding which releases as a result of the longitudinal forces is sufficient in order to cope with the dangerous situations that occur in practice.

Simplified kinematics of the opening process are achieved by the present invention, so that the binding is of a simpler arrangement and shows a higher operational security. This is an important aspect, as such a safety binding must operate reliably under very unfavourable ambient temperatures. Low temperatures, snow and the formation of ice and the like must not disadvantageously influence the operation of such a binding. As a result of its constructional arrangement, the binding in accordance with the invention is capable of being produced to a large extent of carbon fibres. In this way it is possible to achieve an extraordinary tenacity at low weight.

A particularly stable embodiment is achieved in particular in such a way that preferably the connecting element is arranged as a connecting link which is in connection with the binding carrier plates by way of positive-locking releasable connections and which is held on the snowboard movable in the longitudinal direction in a captive manner. It may be provided in this respect that the connecting link is pretensioned by springs in the unloaded condition into a middle position. In this way the rider can step into the binding substantially more easily after the opening.

It has proved to be particularly favourable from a constructional point of view if spring bolts are provided on the binding base plates which are arranged movable in the transversal direction of the snowboard and which comprise holding noses and if recesses are provided in the binding base plates for latching the spring bolts, with the holding noses fixing the binding carrier plates in the upward direction. The recesses are particularly preferably sloped, namely in a conical manner in order to allow the latching of the binding carrier plates in the perpendicular direction downwardly from above. In this way the stepping into the binding is made perpendicular from above. The rider has the possibility to support the stepping-in process with their entire body weight.

It is possible that four spring bolts be provided for each binding carrier plate, which bolts are substantially arranged on the corners of a rectangle which is parallel to the longitudinal axis of the snowboard.

In a particularly preferable embodiment of the invention it is provided, however, that two spring bolts are provided for each binding carrier plate, with advantageously two fixed holding means being arranged for guiding the binding carrier plates on the binding base plates. The advantage of this embodiment is that by reducing the number of active holding elements the adjustability of the binding is facilitated, as only two spring bolts need to be adjusted. The fixed holding means can simultaneously assume the role of the guide elements in this embodiment. A further advantage of this embodiment is that the spring bolts in this embodiment must be pretensioned stronger at the same releasing force than in the variant with four spring bolts. Any adhering snow is pressed out more securely from the binding when stepping in. Furthermore, it is preferable that such a binding comprises fewer movable parts and therefore comes with a simpler arrangement.

It is particularly favourable if limit stop buffers are provided in the binding base plate, which in the case that the binding carrier plate is obliquely positioned limit the movement of the binding carrier plate in such a way that it snaps into the fixed holding means. As owing to the fixed holding means any introduction of the shoe from above is no longer possible in the zone of the fixed holding means, the stepping-in process in this embodiment occurs in such a way that the binding carrier plate is guided obliquely below the fixed holding means and is then tilted downwardly about the fixed holding means on reaching the latching position, with the holding noses snapping into the spring bolts. A stop is formed by the limit stop buffers which limits the movement of the binding carrier plate, so that the position for stepping in no longer has to be actively sought by the rider. The limit stop buffers, however, are of a height which is dimensioned such that when the binding carrier plate is horizontal there is no obstruction to the opening movement.

In a further preferred embodiment of the invention it is provided that the recesses of the binding carrier plates are laterally limited by shoulders whose height differ forwardly and rearwardly. Generally, the shoulders of the recesses of the two bindings will be arranged in a mirror-inverted manner, so that the one binding will have a lower opening force forwardly and the other binding a lower opening force rearwardly. The connecting link finally achieves that the releasing force is the sum total of the releasing forces of the two bindings in the respective direction. In the case of the similar projection of all spring bolts the releasing force of forwardly and rearwardly is equivalent. As a result of the opposite adjustment of the spring bolts, it is very easy to set a different forward and rearward releasing force. This is highly desirable and advantageous for a number of riding situations and styles.

The invention is now explained in closer detail by reference to the embodiments shown in the drawings, which:

DETAILED DESCRIPTION OF THE PREFERRED EMBODIMENTS

Figure 2:
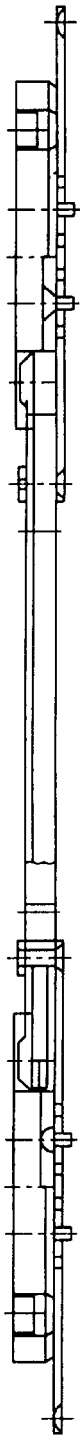
FIG. 2 shows a side view of the binding of FIG. 1.
Figure 1:
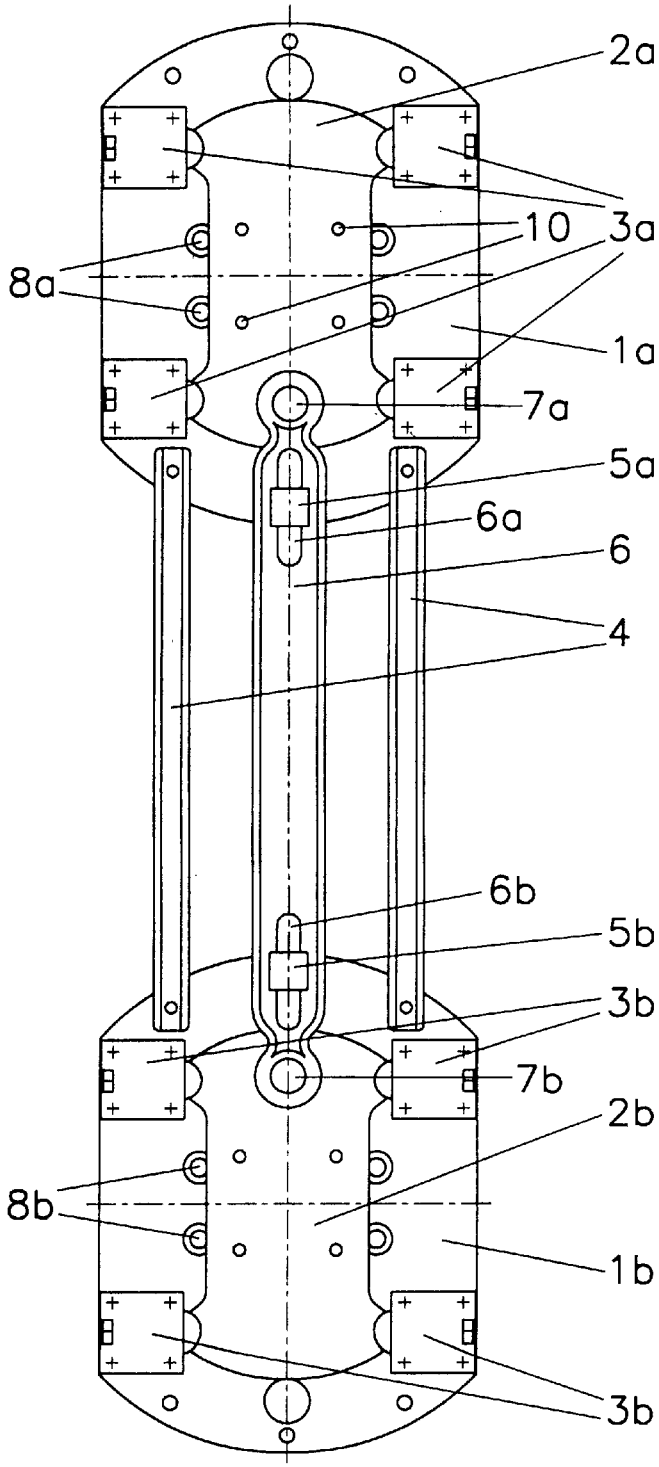
FIG. 1 shows a top view of a binding in accordance with the invention.

The binding of FIGS. 1 and 2 consists of a forward and a rear binding base plate 1*a* and 1*b* which hold a forward and rear binding carrier plate 2*a* and 2*b*. Four holding elements 3*a*, 3*b* are provided on each binding base plate 1*a*, 1*b* which hold the binding carrier plates 2*a*, 2*b* at their edges. The holding elements 3*a*, 3*b* are arranged as spring bolts whose arrangement will be explained below in closer detail.

In contrast to a ski, a snowboard is arranged so as to receive relatively large torsional strains about the release axis. An experienced rider will actively use the torsion to influence the riding behaviour by exerting opposing tilting moments on the bindings. During this it is possible to cause a torsion of up to 20°. In addition, the board is deflected under load. In order to prevent twisting or erroneous releases by the rigid connection by the connecting link 6, the binding base plate on the snowboard is arranged displaceable within limits in the longitudinal direction on the snowboard. Connecting rods 4 are provided to maintain the precise distance between the binding base plates 1*a*, 1*b*. The connecting link 6 is held on the binding base plates 1*a*, 1*b* in a captive manner between the connecting rods 4 by way of fixing means 5*a*, 5*b*. As an alternative to this, it is also possible that only one connecting rod is provided immediately below the connecting link. In this way it is possible to achieve an even more precise adherence to the distance of the binding base plates 1*a*, 1*b* in the zone of the connecting link.

The connecting link 6 comprises at its two ends omega-shaped holding projections 7*a*, 7*b* which engage in a positive-locking manner in respective recesses of the binding carrier plates 2*a*, 2*b*. The holding projections 7*a*, 7*b* are upwardly arranged in a truncated way in order to facilitate the introduction of the binding carrier plates 2*a*, 2*b* from above. Four pins 8*a*, 8*b* are attached on the binding base plates 1*a*, 1*b* at the side of the binding carrier plates 2*a*, 2*b*, which pins represent the guide elements for the lateral guidance of the binding carrier plates 2*a*, 2*b*.

The rider steps into this binding in such a way that the binding carrier plates 2*a*, 2*b*, which are connected with the rider's feet by way of holding elements (not shown), can be inserted perpendicularly from above onto the binding base plate 1*a*, 1*b*. The binding carrier plates 2*a*, 2*b* simultaneously snap into the spring bolts 3*a*, 3*b* of the binding base plates 1*a*, 1*b* and are centred in their correct position by the pins 8*a*, 8*b*. Furthermore, the engagement of the binding carrier plates 2*a*, 2*b* occurs in the holding projections 7*a*, 7*b* of the connecting link 6. The binding base plate 1*b* is screwed onto the snowboard (not shown in closer detail) by screws (not shown). The binding base plate 1*a* is movably fastened to the snowboard through screws 9 which are arranged in oblong holes 9*a*. Screw bores 10 on the binding carrier plates 2*a*, 2*b* are provided for fastening the fastening apparatuses for the boots.

Figure 3:
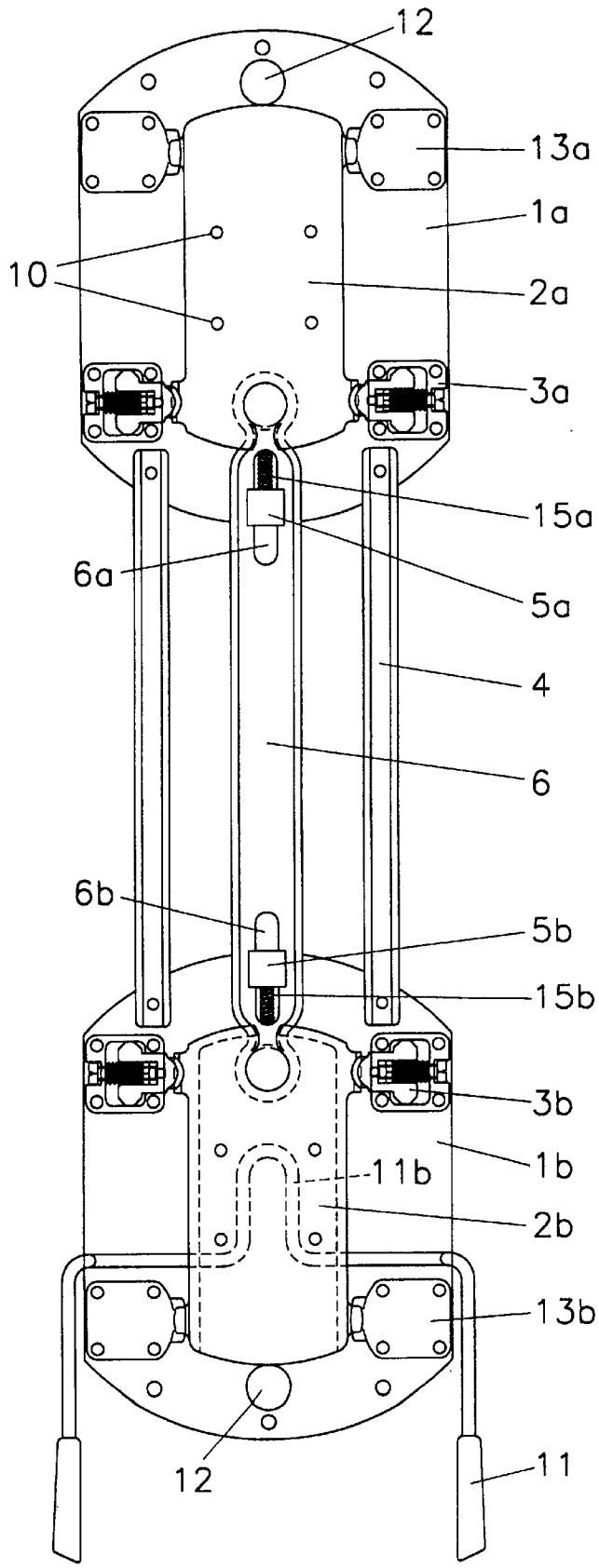
FIG. 3 shows a top view of a further embodiment of the invention.

The embodiment of FIG. 3 is distinguished from the foregoing embodiment in that the binding carrier plates 2*a*, 2*b* are each held by two spring bolts 3*a*, 3*b* and that furthermore two fixed holding means 13*a*, 13*b* are provided. The fixed holding means 13*a*, 13*b* guide the binding carrier plates 2*a*, 2*b* laterally and hold them upwardly. Limit stop buffers 12 are provided on the binding base plates 1*a*, 1*b* in order to facilitate stepping into the binding. Furthermore, springs 15*a*, 15*b* are inserted in this embodiment in the oblong holes 6*a*, 6*b* of the connecting link, which springs pretension the connecting link 6 in the unstrained condition in its middle position. This not only allows the rider to step into the binding more easily, but an additional effect is achieved which is that the required releasing force is increased by the force which is required for displacing the connecting link. However, the characteristics of the release are also changed. The release under load caused by an impact, i.e., during an extremely short-term action of force, is changed only very little. Slower acting forces, are absorbed by the springs 15*a*, 15*b* to a relevant extent. In this way erroneous releases in deep snow which are caused by strong forces acting upon the snowboard can be better avoided.

An automatic braking apparatus 11 is arranged in the type of a ski stop with an actuating bow 11*a* on the binding base plate 1*b* and below the binding carrier plate 2*b* in the known manner.

Figure 4:
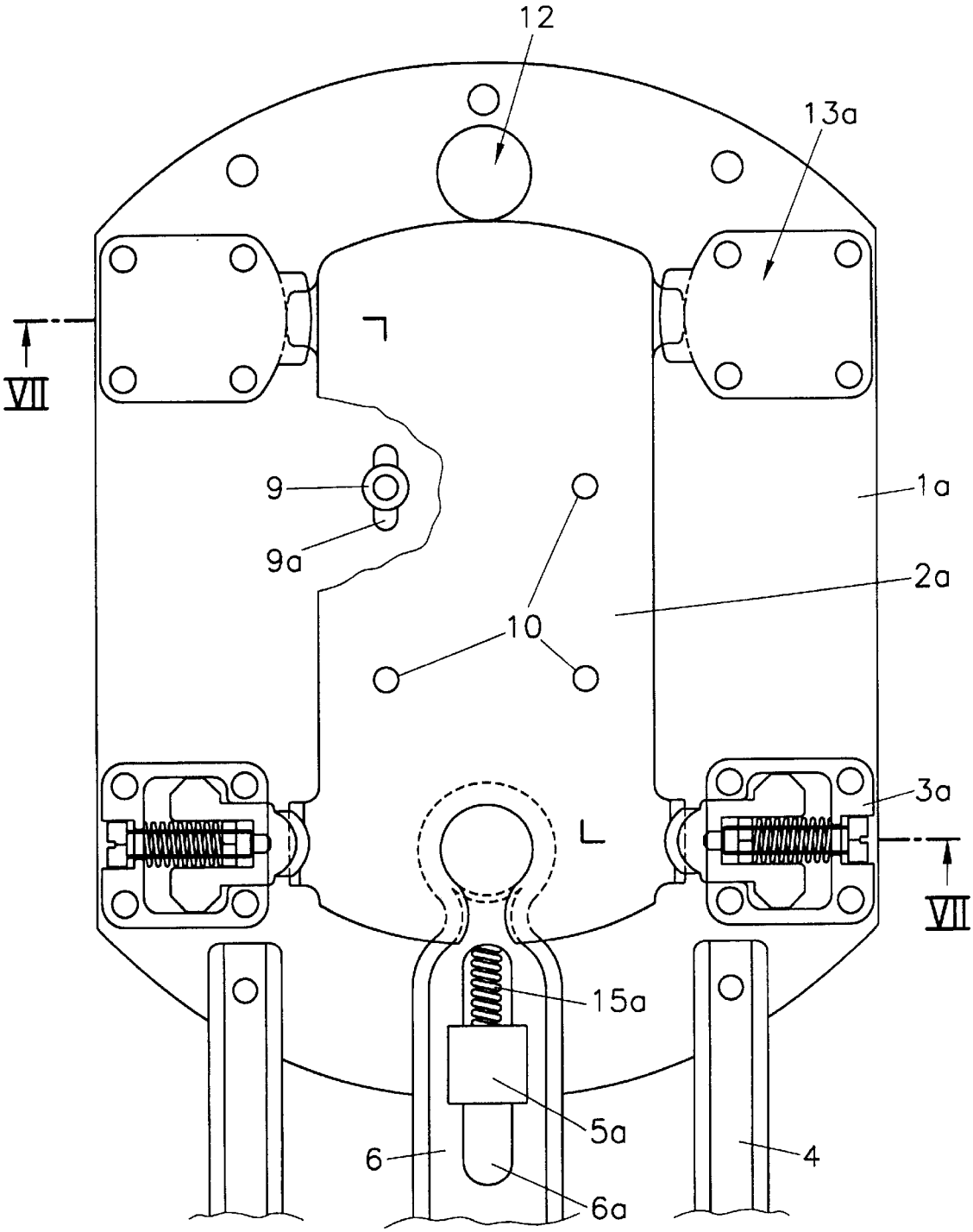
FIG. 4 shows the forward part of the binding of FIG. 3 on an enlarged scale.
Figure 5:
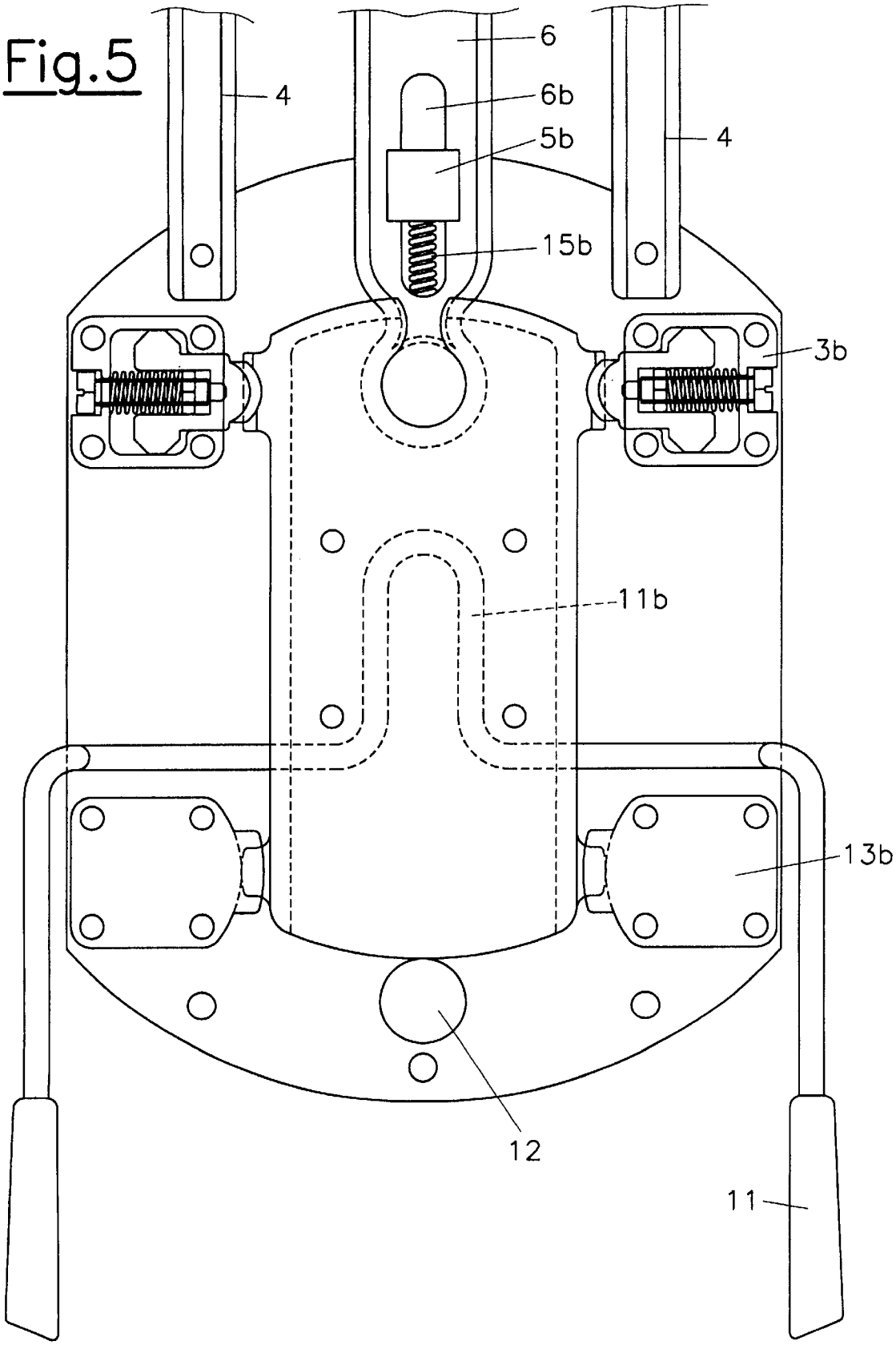
FIG. 5 shows the rear part of the binding of FIG. 3 on an enlarged scale.

FIGS. 4 and 5 show the forward and rear section of the binding in accordance with the invention pursuant to FIG. 3 in a more detailed representation.

Figure 6:
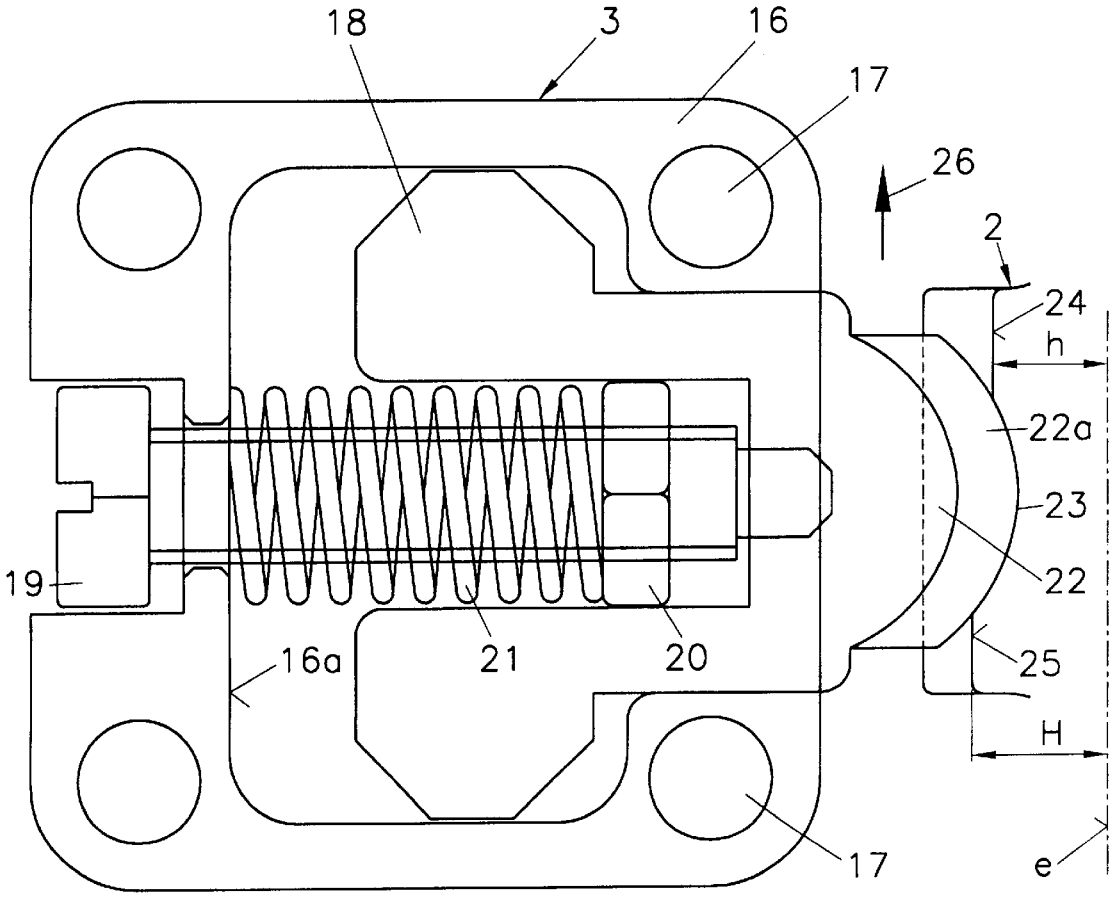
FIG. 6 shows a spring bolt on an enlarged scale.

FIG. 6 shows a holding element with a spring bolt. Its arrangement is illustrated. The holding element is generally indicated with reference numeral 3, because it can principally be used both for the forward as well as the rear binding. The holding element 3 consists of a casing 16 which is connected by way of screws 17 with the binding base plate 1*a* or 1*b*. A slide 18 is displaceably arranged in the casing 16, which slide is pretensioned by a spring 21. The coil spring 21 is wound around a screw 19 and extends between a nut 20 of the screw 19 and an inner wall 16*a* of the casing 16. The pretensioning force of spring 21 and thus the releasing force of the binding can be set by turning screw 19. A holding nose 22 is provided which comprises a surface 22*a* which is inclined upwardly in a semi-conical shape. The holding nose 22 holds binding carrier plate 2, which is shown only schematically, by engaging in a recess 23 which is laterally limited by shoulders 24 and 25. The height h of the shoulder 24 from a randomly chosen reference plane e which is parallel to the longitudinal axis of the snowboard is smaller than the height H of the shoulder 25 from the same reference plane e. In this way the releasing force of the spring bolt in the direction of arrow 26 can be smaller than in the direction opposite to this.

The holding nose 22 is extendable to such an extent that it is impossible, when the binding is released, to be pushed back again into the binding inadvertently by a reversal of the outwardly acting forces. This would be very dangerous, particularly if only one binding were to close again. However, as the holding nose extends to such an extent that a movement of the binding carrier plate 2*a*, 2*b* is prevented as it impinges upon the side area of the holding nose 22, this danger can securely be prevented.

Figure 7:
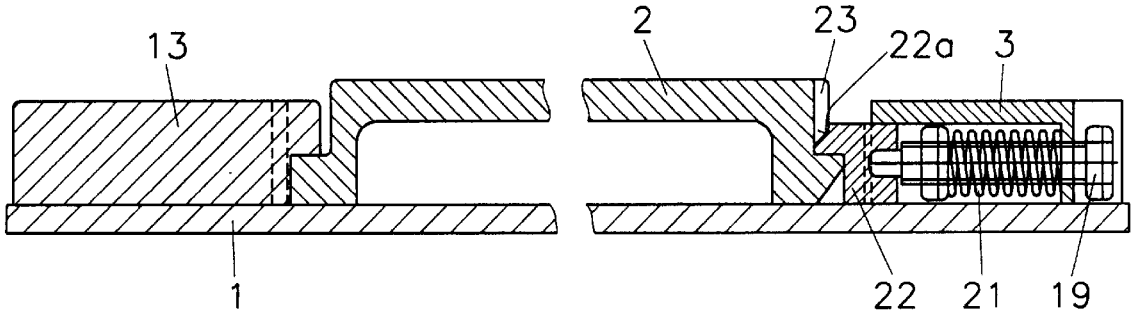
FIG. 7 shows a sectional view along line VII—VII in FIG. 4.

FIG. 7 shows a binding in accordance with the invention in a sectional view. The left half shows a fixed holding means 13, whereas the right half shows a spring bolt 3, both of which are fastened on a binding base plate 1. This figure also shows the recess 23 and the bevelled surface 22*a* of slide 22.

Figure 8:
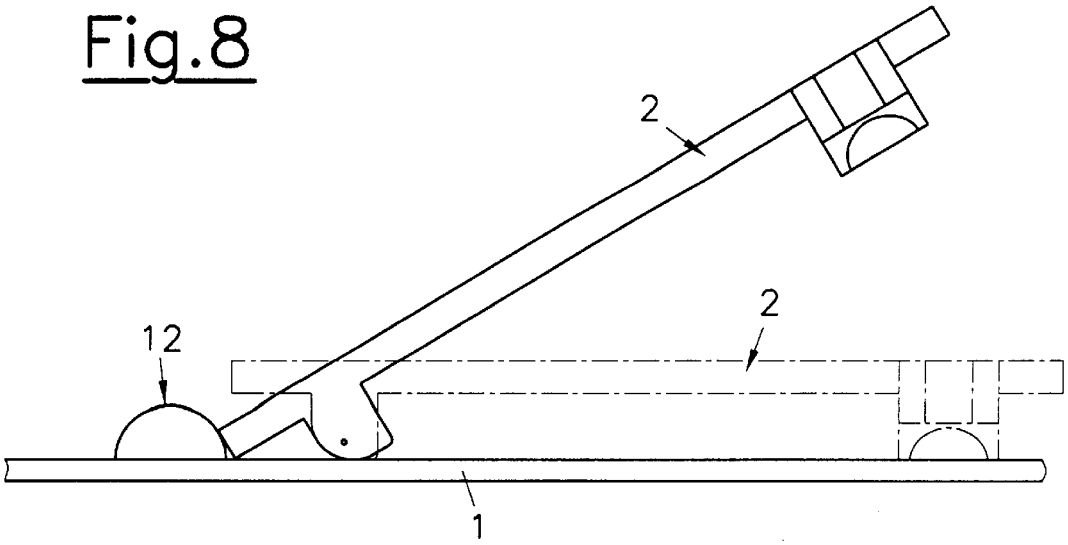
FIG. 8 schematically shows a side view explaining the stepping into the binding.

FIG. 8 schematically explains stepping into the binding of the embodiment of FIGS. 3 to 7. The binding carrier plate 2 is inserted in an inclined condition below the fixed holding means 13, with the limit stop buffers 12 facilitating the insertion. After contact the binding carrier plate 2 is brought downwardly into the dot-dash position, so that the spring bolts 3*a* snap in and hold the binding carrier plate 2.

The present invention allows production of a binding of a very simple arrangement which optimally considers the specific particularities of snowboards and is highly resistant and insensitive to rough operation at low temperatures and different snow conditions.

It is furthermore advisable to provide a teflon coating, preferably of the metal parts, in order to prevent any adherence of snow to the highest possible extent.

What is claimed is:

1. A binding for a snowboard which comprises:

first and second binding carrier plates which are attachable to one shoe of a user;

first and second binding base plates which are attachable to a snowboard so as to be aligned with said first and second binding carrier plates respectively when secured thereto, said first and second binding base plates each including holding elements for holding a respective first and second binding carrier plate thereon yet releasing said respective first and second binding carrier plates only in a longitudinal direction of the snowboard, and a connecting element connected between said first and second binding carrier plates to forcibly release said second binding carrier plate from attachment to said second binding base plate upon release of said first binding carrier plate from said first binding base plate.

2. A binding as claimed in claim 1, wherein the connecting element is a connecting link which is connected to the first and second binding carrier plates by way of positive-locking releasable connections and is held on the snowboard to be movable in the longitudinal direction in a captive manner.

3. A binding as claimed in claim 2, wherein the connecting link is pretensioned by springs to be in a middle position when not loaded.

4. A binding as claimed in claim 1, wherein spring bolts are provided on the binding base plates which are movable in a transversal direction to said longitudinal direction and which comprise holding noses cooperable with recesses in the binding carrier plates for latching the carrier plates, with the holding noses upwardly fixing the binding carrier plates.

5. A binding as claimed in claim 4, wherein the recesses and/or the holding noses are bevelled in order to allow latching of the first and second binding carrier plates in a perpendicular direction downwardly from above.

6. A binding as claimed in claim 4, wherein four spring bolts are provided for each binding carrier plate, which bolts are substantially arranged on the corners of a rectangle which is parallel to said longitudinal direction.

7. A binding as claimed in claim 4, wherein two spring bolts are provided for each binding carrier plate, with two fixed holding means being arranged for guiding the binding carrier plates on the binding base plates.

8. A binding as claimed in claim 7, wherein the spring bolts are arranged on the corners of a rectangle which is parallel to the longitudinal direction, which bolts are situated closest to the link.

9. A binding as claimed in claim 7, wherein limit stop buffers are provided on each binding base plate, is obliquely positioned, limit the movement of the binding carrier plate in such a way that the same snaps into the fixed holding means.

10. A binding as claimed in claim 4, wherein the recesses of the first and second binding carrier plates are limited laterally by shoulders whose height is different forwardly and rearwardly.

11. A binding as claimed in claim 1, wherein the first and second binding base plates are provided with lateral thrust bearings in order to center the position of the first and second binding carrier plates.

12. A binding as claimed in claim 1, wherein a first of the first and second binding base plates is rigidly connected with the snowboard and the second binding base plate is attached with limited movability in the longitudinal direction and is connected by way of connecting rods with the first binding base plate.

13. A binding as claimed in claim 1, wherein a braking device is provided which includes an actuating bow that is arranged between one of said first and second binding base plates and a respective binding carrier plate.

14. A combination of a snowboard which defines a longitudinal direction and a binding therefor which comprises:

first and second binding carrier plates which are attachable to one shoe of a user, first and second binding base plates which are attachable to said snowboard so as to be aligned with said first and second binding carrier plates respectively when secured thereto, said first and second binding base plates each including holding elements for holding a respective first and second binding carrier plate thereon yet releasing said respective first and second carrier plates only in said longitudinal direction of the snowboard, and a connecting element connected between said first and second binding carrier plates to forcibly release said second binding carrier plate from attachment to said second binding base plate upon release of said first binding carrier plate from said first binding base plate.

* * * * *